US005800029A

United States Patent [19]

Robertson et al.

[11] Patent Number: 5,800,029

[45] Date of Patent: Sep. 1, 1998

[54] COMBINATION WORK AND STORAGE CABINETS

[75] Inventors: Joann Robertson, Vancouver; Andy Holisky, Burnaby, both of Canada

[73] Assignee: Suite Solutions Designs Ltd., Vancouver, Canada

[21] Appl. No.: 835,010

[22] Filed: Apr. 8, 1997

[51] Int. Cl.[6] ..... A47B 81/00

[52] U.S. Cl. ..... 312/271; 312/298; 312/313; 108/40; 108/38

[58] Field of Search ..... 312/271, 274, 312/313, 302, 298, 275, 276; 5/147, 150.1, 158; 108/40, 33, 38

[56] References Cited

U.S. PATENT DOCUMENTS

| | | | |
|---|---|---|---|
| 135,440 | 2/1873 | Partridge | 108/38 X |
| 371,871 | 10/1887 | Ayres | 5/147 |
| 409,065 | 8/1889 | Rauf | 5/158 |
| 432,073 | 7/1890 | Poulson | 5/158 |
| 438,132 | 10/1890 | Anderson et al. | 5/158 |
| 456,965 | 8/1891 | Sanor | 5/147 |
| 514,108 | 2/1894 | Wilmot | 312/271 |
| 584,101 | 6/1897 | Welch | 5/158 |
| 656,980 | 8/1900 | Jeffcott | 5/150.1 |
| 1,004,104 | 9/1911 | Taylor | 5/158 |
| 1,675,953 | 7/1928 | Nichol | 108/38 |
| 1,996,767 | 4/1935 | Hunter | 312/271 X |
| 2,484,377 | 10/1949 | Eramo et al. | 5/158 |
| 2,628,371 | 2/1953 | Null | 5/147 X |
| 2,878,089 | 3/1959 | Mark . | |
| 3,062,544 | 11/1962 | Viets | 108/40 X |
| 3,806,217 | 4/1974 | Current . | |
| 3,823,993 | 7/1974 | Kakishima et al. . | |
| 4,263,854 | 4/1981 | Moore et al. | 108/40 X |

FOREIGN PATENT DOCUMENTS

| | | | |
|---|---|---|---|
| 209864 | 3/1921 | Canada . | |
| 965135 | 3/1975 | Canada . | |
| 1125345 | 8/1982 | Canada . | |
| 947709 | 1/1949 | France | 5/150.1 |
| 88306 | 12/1966 | France | 5/147 |
| 964177 | 11/1956 | Germany | 312/298 |
| 411365 | 1/1934 | United Kingdom | 108/38 |
| 1073622 | 6/1967 | United Kingdom | 108/38 |

*Primary Examiner*—Peter R. Brown
*Assistant Examiner*—David E. Allred
*Attorney, Agent, or Firm*—Killworth, Gottman, Hagan & Schaeff, L.L.P.

[57] ABSTRACT

A cabinet for a sewing machine or the like defines a chamber having a front and a back including a back panel. A pull-out platform for the machine is supported in the chamber for motion inwardly and outwardly of the front thereof and defines a generally horizontal working surface. The back panel is flexibly connected to the platform for movement therewith from (A) a generally vertical position wherein the back panel closes the back of the chamber (e.g. during machine storage, the vertical position corresponding to an innermost position of the platform), to (B) a generally horizontal position wherein the back panel is in generally co-planar relation to the platform (to provide a large working surface) and the back of the chamber is open (to allow fabric etc. being worked on to be moved through the open back). The horizontal position also corresponds to an outermost position of the platform.

9 Claims, 7 Drawing Sheets

COMBINATION WORK AND STORAGE CABINETS

BACKGROUND OF THE INVENTION

This invention relates to improvements in combination work and storage cabinets, particularly those adapted for use with a sewing machine or like apparatus.

The prior art has provided various types of cabinets and tables for use with sewing machines and the like. The following patents have been noted as possible interest:

| | | |
|---|---|---|
| | Canadian Patents | |
| 209,864 | Guidal | Mar. 29, 1921 |
| 965,135 | Sakow | Mar. 25, 1975 |
| 1,125,345 | Roberts et al. | 1982 |
| | U.S. Patents | |
| 2,878,089 | Mark | Mar. 17, 1959 |
| 3,806,217 | Current | Apr. 23, 1974 |
| 3,823,993 | Kakishima et al. | July 16, 1974 |

The above noted Canadian patents show various forms of tables which can be manipulated to provide a larger work surface for use with sewing machines and the like. The U.S. patents also show sewing machine cabinets and cabinet boxes, the various panels of which may be manipulated and moved into positions to provide convenient work supporting surfaces and which may be folded up for compact storage and the like.

SUMMARY OF THE INVENTION

It is a basic objective of the present invention to provide a combination work and storage cabinet for sewing machines and the like which, when closed, is relatively compact and which, when opened, provides a relatively large working surface with the back of the cabinet also opening at the same time so that larger pieces of fabric can be pushed through the open back of the cabinet as the fabric is being worked on.

It is a further objective to provide a cabinet of the type noted above arranged such that the back of the cabinet can open without the cabinet having to be moved out from a wall of a room and a section of the cabinet back removed.

It is a further objective of the invention to provide a cabinet of the type indicated above and having a slide-out work surface or platform with the back portion of the cabinet being connected to this platform such as to follow the platform as it is being pulled out and to move into a coplanar relation therewith to provide a relatively large working surface, with the back of the cabinet being thus opened up so as to permit large pieces of fabric to be pushed through as they are being worked on.

Accordingly, the invention in one aspect provides a cabinet defining a chamber having a front, a back including a back panel, and a pull-out platform supported in said chamber for motion inwardly and outwardly of the front thereof and defining a generally horizontal working surface, said back panel being flexibly connected to said platform for movement therewith from (A) a generally vertical position wherein said back panel closes the back of said chamber, said vertical position corresponding to an innermost position of said platform, to (B) a generally horizontal position wherein said back panel is in generally co-planar relation to said platform and the back of said chamber is open, said horizontal position corresponding to an outermost position of said platform.

In accordance with a further aspect of the invention there is provided means associated with said back panel for directing and supporting movement of the back panel between the generally vertical and generally horizontal positions.

In a preferred form of the invention, cam means are associated with the back panel for directing and supporting the movement of the back panel in a predetermined manner between the two positions noted above.

In a preferred embodiment of the invention, the platform is supported for rectilinear motion inwardly and outwardly relative to the front of the chamber defined by the cabinet by means of extension slides or the like while at the same time the back panel is flexibly connected to the platform by means of an elongated piano type hinge.

Further aspects and advantages of the invention will become more readily apparent from the following description of a preferred embodiment of the invention.

BRIEF DESCRIPTION OF THE VIEW OF DRAWINGS

DETAILED DESCRIPTION OF THE PREFERRED EMBODIMENT

Figure 1:
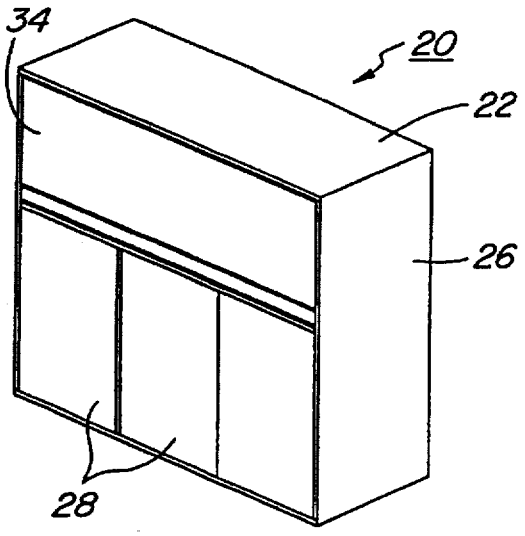
FIG. 1 is a perspective view of the cabinet in the fully closed condition.
Figure 2:
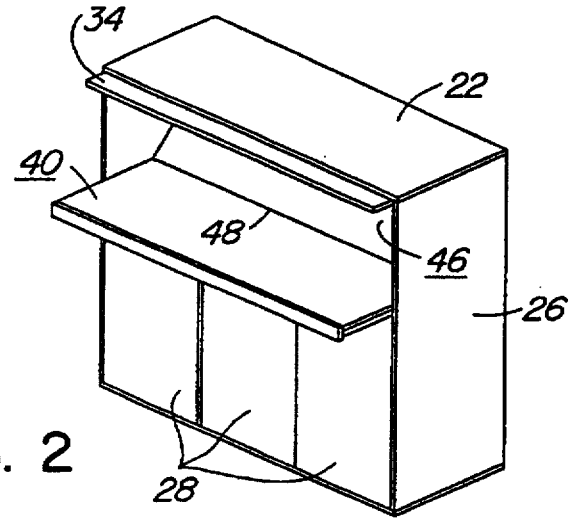
FIG. 2 is a perspective view of the cabinet with the pull-out platform partially extended and the cabinet back-panel in an intermediate position.
Figure 3:
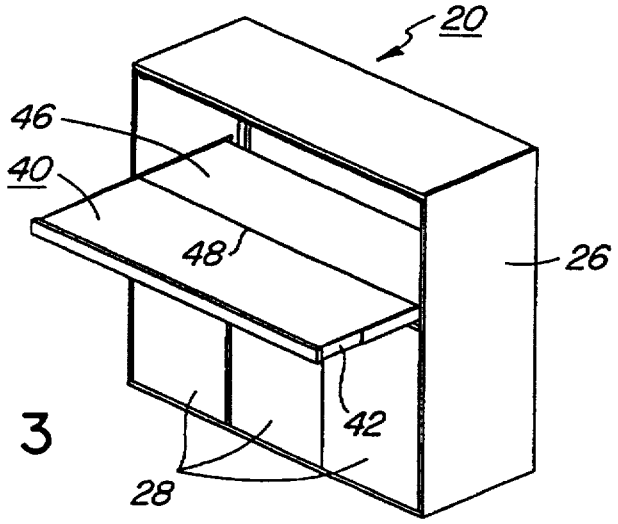
FIG. 3 is a perspective view of the cabinet with the pull-out platform fully extended and in co-planar relation with the back panel, the back of the cabinet chamber being fully open.

Referring now to the drawings, particularly FIGS. 1–4, there is shown a cabinet 20 of rectangular outline configuration, the cabinet including horizontally disposed top panel 22 and horizontal bottom panel 24 between which extend opposed end panels 26. The lower front of the cabinet is provided with three front doors 28 which are mounted in any desired conventional manner which need not be described further. The lower part of the cabinet is provided with a fixed back wall (not shown). A top panel support rail 29 extends between the upper rear corners of the opposed end panels 26.

Figure 4:
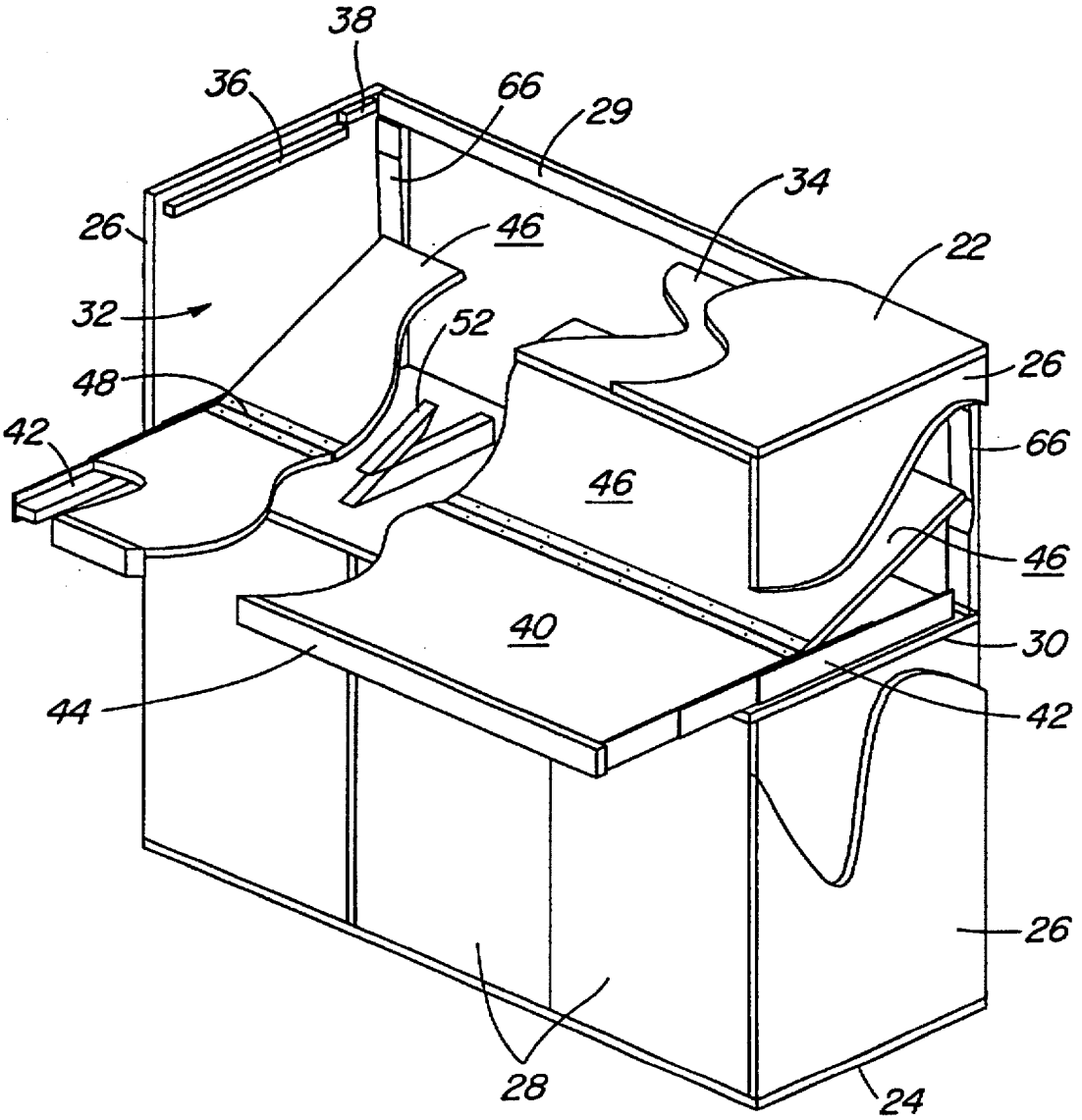
FIG. 4 is a perspective view of the cabinet with the pull-out platform and the back panel in intermediate positions, the figure being cut away partially to show the interior structures.

The upper part of the cabinet is defined between the top panel 22 and a horizontal middle panel 30 (see FIG. 4)

which, with end panels 26, serve to define a chamber 32, the front of which chamber may be closed by a so-called "lawyers bookcase" door 34. This door 34 is mounted for movement by means of door rails 36 fixed to the inner surfaces of panels 26 in spaced relation to top panel 22. In use, the lower edge of door 34 may be swung outwardly to bring the door into parallelism with the top panel 22, with door 34 thereafter being slid inwardly while supported on the rails 36 until the door stops 38 are reached. The construction and mounting of door 34 is, in itself, well known in the art generally and need not be described further here.

A pull-out platform 40 is supported within the chamber 32 immediately above the middle panel 30 for movement inwardly and outwardly of the front of the chamber 32. The platform 40 is supported for sliding rectilinear motion inwardly and outwardly of the front of the cabinet by means of a pair of full extension slide assemblies 42, one end of each slide assembly being fixed to an associated end of the platform 40 while the other end of each slide assembly is fixed to the middle panel 30 and/or associated end panel 26. The slide assemblies 42 are readily available commercially and need not be described in further detail here. It might also be noted that the front edge of pull-out platform 40 is provided with a narrow decorative strip 44 whereby to provide the cabinet with an attractive appearance when the platform 40 is in its innermost position.

An elongated rectangular back panel 46 is connected to the rear or inner edge of the platform 40 by means of an elongated piano type hinge 48.

Referring now particularly FIGS. 4–7, the middle panel 30 is provided on its top surface with three spaced apart fixed cams 50. Likewise the back panel 46 is provided with three correspondingly positioned moveable cams 52. The fixed cams 50 are secured tightly to the middle panel 30 while the moveable cams 52 are secured firmly to the rear wall of the back panel 46. The fixed cams 50 are each provided with a forwardly directed inclined ramp 54 and a horizontal top surface 56 parallel to the top surface of the middle panel 30. Similarly the moveable cams 52 are each provided with opposed inclined ramp portions 58 and 60 separated by an intermediate cam surface 62.

The back of chamber 32, adjacent to the opposing ends thereof, is provided with a spaced apart pair of vertical cam posts 66. The function of the cam posts 66 is to guide and support the back panel 46 as the latter moves toward and away from its vertical position as will be described in more detail hereafter. For this purpose, each cam post 66 is provided with a forwardly facing cam surface 68, the upper portion 68A of which is inclined downwardly and rearwardly as best seen in FIGS. 5 and 6 with the lower end of such cam surface merging with shallowly concavely curved cam surface portion 68B also as best seen in FIGS. 5 and 6.

Figure 5:
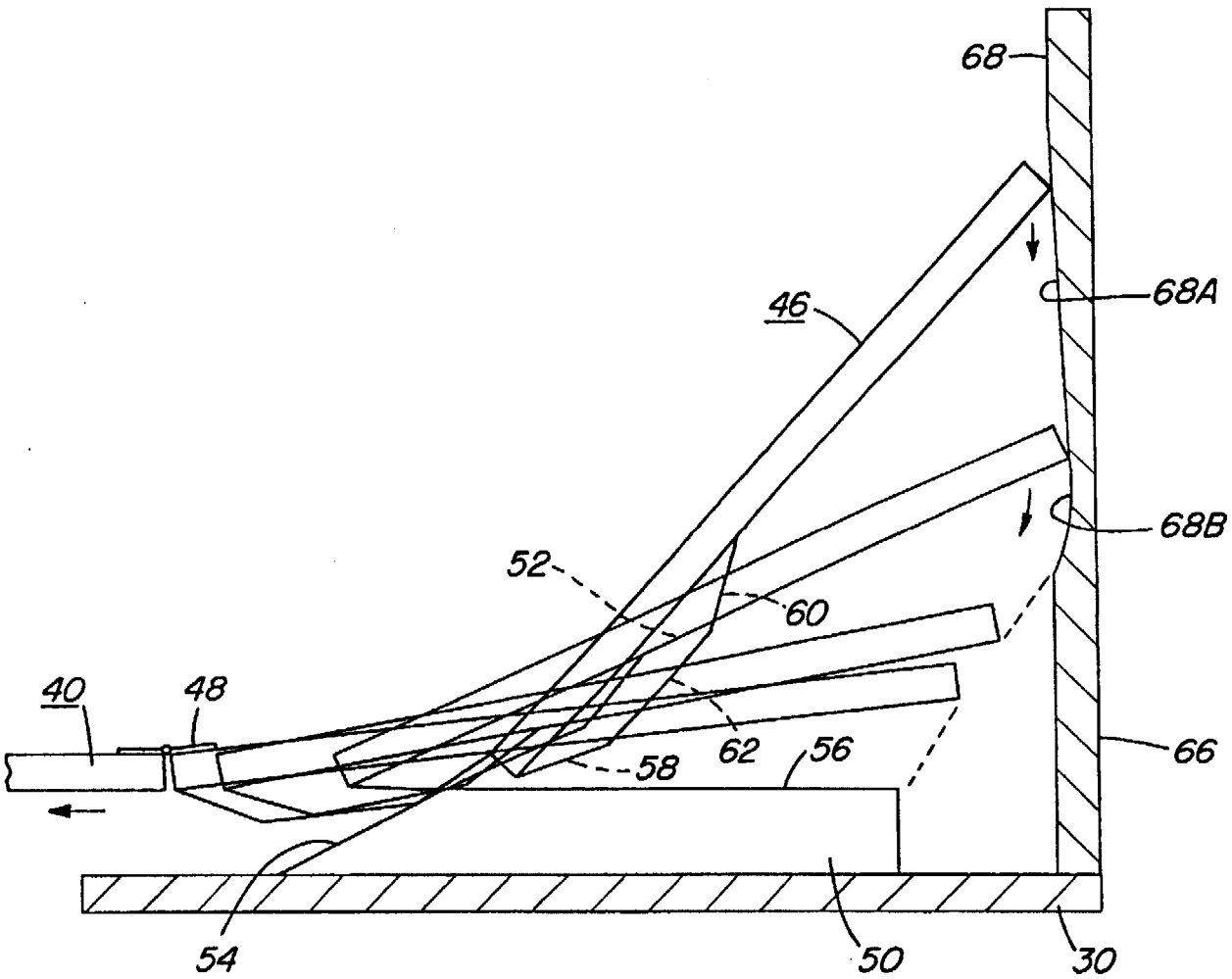
FIGS. 5 and 6 are somewhat diagrammatic partial section views of the cabinet chamber illustrating the positions taken by the pull-out platform and the back panel as they are moved to and through various positions.
Figure 6:
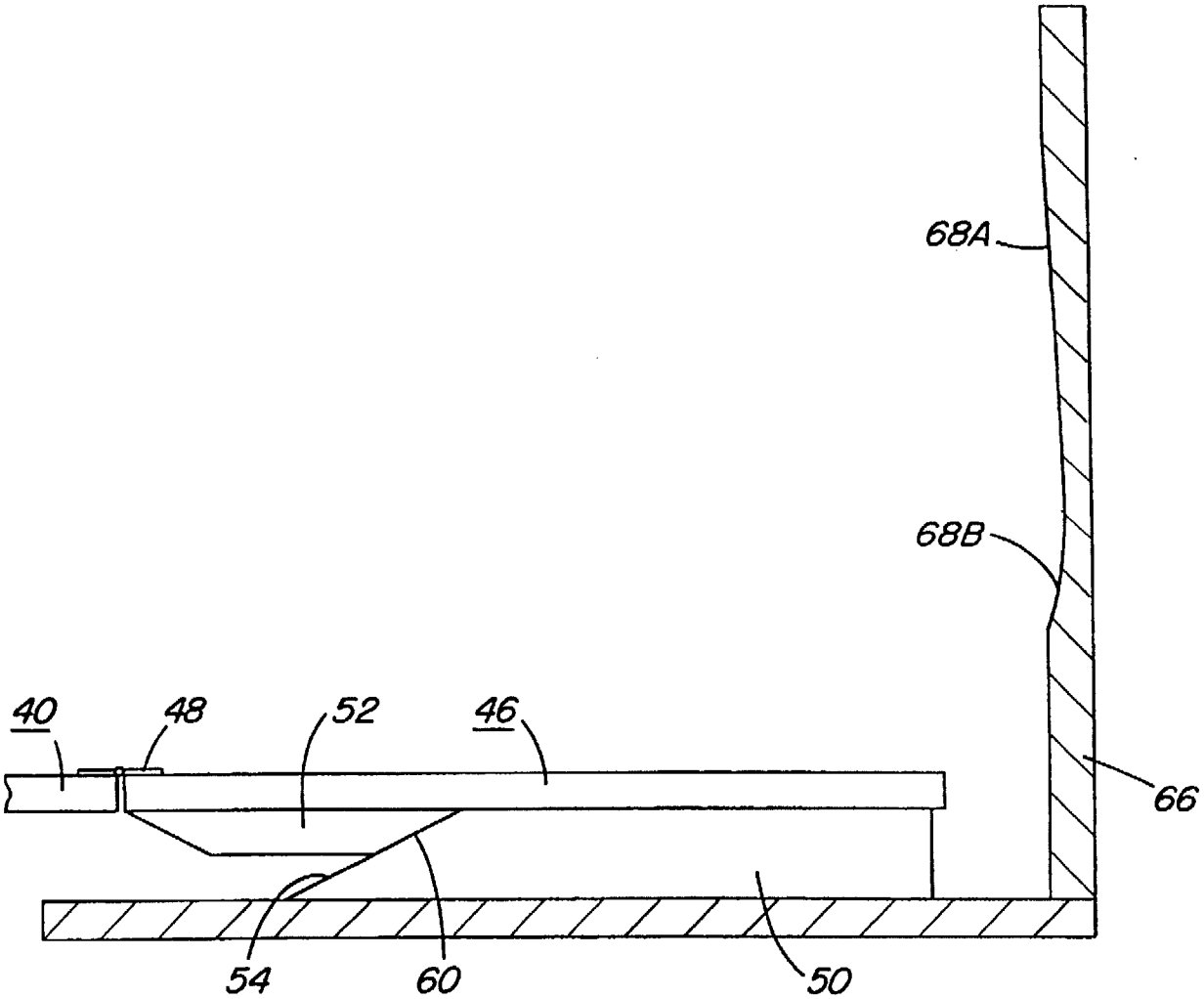
Figure 7:
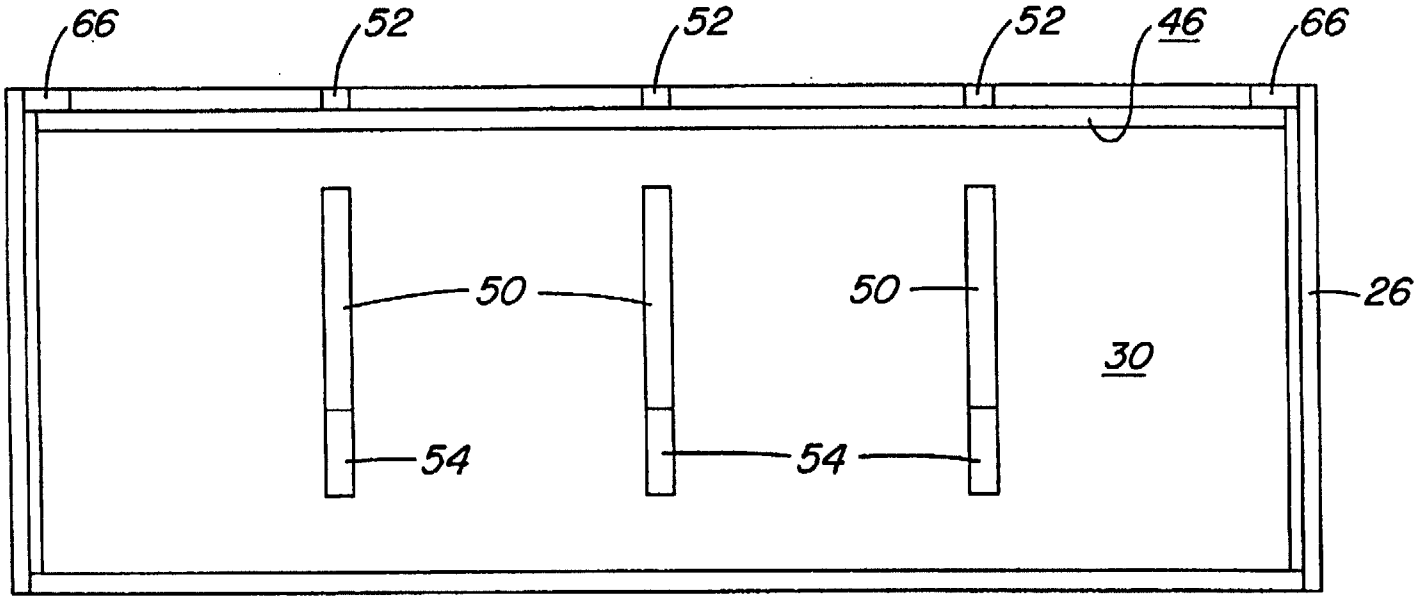
FIG. 7 is a top plan view of the cabinet with the top panel thereof and the pull-out platform removed thereby to show the relative positions of certain of the component parts.

In operation, firstly with reference to FIGS. 5 and 6, as platform 40 is pulled outwardly and away from the cabinet chamber 32, the bottom edge of back panel 46 is firstly pulled away from the lower part of the cam posts 66 with the upper edge end portions 70 of back panel 46 sliding downwardly along the inclined cam surface 68A as the back panel rotates clockwise about hinge 48. This action continues with the upper edge portions 70 subsequently moving along in contact with the concavely curved cam portion 68B. As this is taking place, the moveable cams 52 come into contact with the fixed cams 50 with the result being that the back panel 46 is supported in various inclined positions after the upper edge portions 70 of the back panel move away from the cam posts 66 until finally, with continued movement outwardly of platform 40, the moveable cams 52 move into the cooperating positions illustrated in FIG. 6 with the ramp 60 of cam 52 in engagement with ramp 54 of the fixed cam 50. At this point each slide assembly 42 supporting the platform 40 will have reached its point of full extension. Also, it will be noted, the back panel will at this point as seen in FIG. 6 have moved into coplanar relationship with platform 40 thus defining an uninterrupted relatively large working surface with extends through the interior of the chamber 32 with the rear of such chamber 32 being completely "open" since it will be realized that the cam posts 66, being relatively narrow and located adjacent the opposing end panels 26, do not in any significant way obstruct the open back of the cabinet enclosure. Thus, fabrics or other materials being worked on by way of a sewing machine (not shown) positioned on pull-out platform 40, can be pushed through the open back of the cabinet chamber and allowed to hang downwardly therefrom thus greatly facilitating the work of the sewing machine operator in a manner which will be readily appreciated by those skilled in this field of the endeavour.

Figure 8:
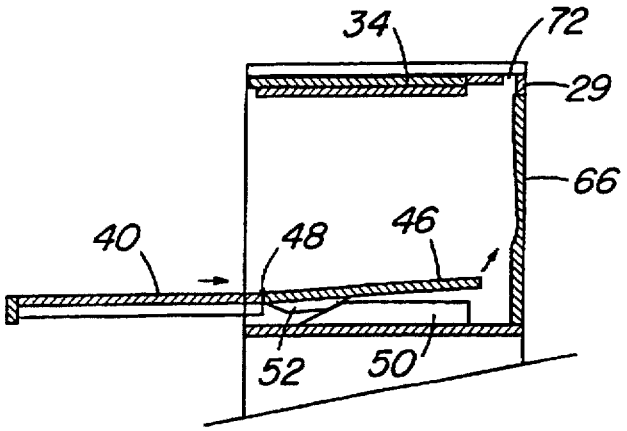
FIGS. 8 through 13 are cross-sectional views of the cabinet chamber showing the various positions occupied by the pull-out platform and the back panel as the platform is moved inwardly relative to the cabinet chamber as well as the manner in which the various cam surfaces interact provide for movement of the back panel from the horizontal to the vertical position.
Figure 9:
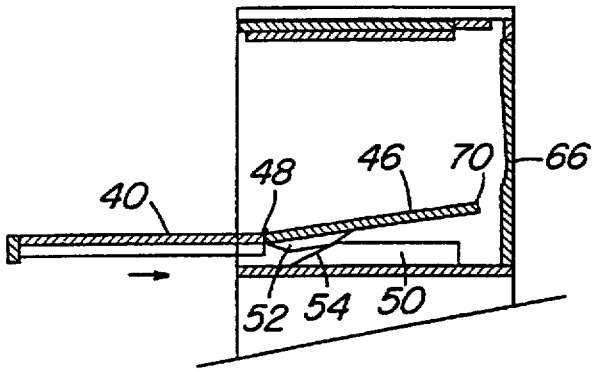
Figure 10:
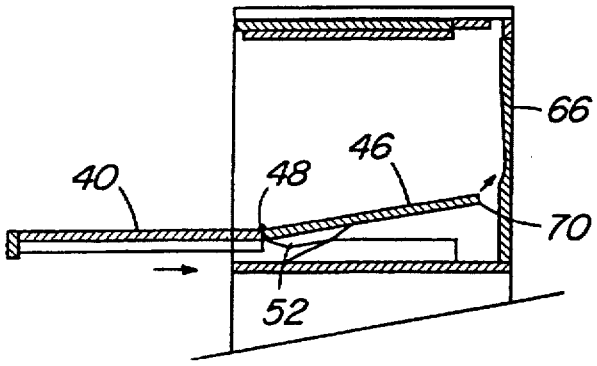
Figure 11:
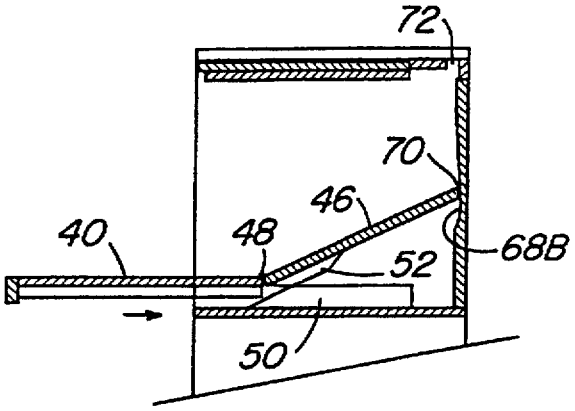
Figure 12:
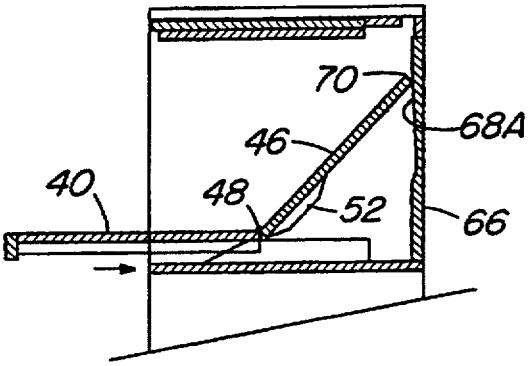
Figure 13:
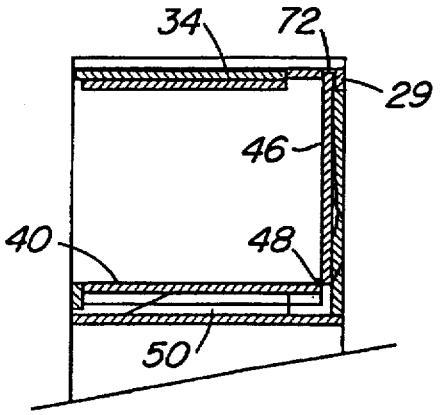

With reference to FIGS. 8–13, the reverse sequence of events is illustrated. Referring firstly to FIGS. 8 and 9 it will be seen that as platform 40 is initially pushed inwardly in the direction of the arrow, that the moveable cams 52 ride up on the ramps 54 of the fixed cams 50 thus causing the back panel 46 to be rotated in the counter-clockwise direction with the free edge 70 thereof being pivoted upwardly in the direction illustrated by the arrow. (A reasonable degree of force is required initially to move platform 40 inwardly as a result of the interaction of cams 50 and 52, this being useful in preventing unwanted inward movement of platform 40 during normal use thereof). This action continues with platform 40 and back panel 46 occupying the relative positions illustrated in FIGS. 9 and 10 until finally, as illustrated in FIG. 11, the edge portions 70 of back panel 46 come in contact with the concavely contoured cam surface portion 68B of the cam posts 66. As inward movement of the platform 40 continues as illustrated in FIG. 12, the edge portions 70 of back panel 46 ride up along the upper inclined cam surface portions 68A thus guiding the back panel 46 as it rotates further counter-clockwise and moves into the final vertical position illustrated in FIG. 13 at which point the upper edge portions 70 at opposed ends of the back panel 46 move into recesses 72 defined between the door stop 38 and the support rail 29 which is disposed on the upper most ends of the cam posts 66. Being thus firmly trapped at each of its opposing ends in the recesses 72, the back panel 46 is prevented from falling forwardly out of its vertical position, it being noted here that the platform 40 is at this point contained fully within the chamber 32. Following this the "lawyers bookcase" door 34 can be slid outwardly and then swung downwardly into a final horizontal position closing the front of the cabinet enclosure as illustrated in FIG. 1 and providing full enclosure for a sewing machine or the like supported on the platform 40.

A preferred embodiment of the invention has been described and illustrated by way of example. It will however, be understood that numerous modifications and changes in design can readily be made by those skilled in the art without departing from the scope and spirit of the present invention.

We claim:

1. A cabinet defining a chamber having a front portion forming a front opening closable by a frontal door and a back portion forming a back opening spaced rearwardly of said front portion, said back opening being covered by a back panel, and a pull-out platform supported in said chamber such that said platform may be moved inwardly and outwardly of said chamber, said platform defining a generally horizontal support surface capable of providing support to an object in both inward and outward positions of said platform relative to said chamber, said back panel being flexibly connected to said platform and being supported for movement with said platform from (A) a generally vertical position wherein said back panel at least partly closes the back portion of said chamber, said vertical position corresponding to an innermost position of said platform, to (B) a generally horizontal position wherein said back panel is in generally co-planar relation to said platform and the back opening of said chamber is uncovered, such that said back panel and said platform together define a substantially uninterrupted working surface which extends rearwardly through said chamber toward the uncovered opening in the back portion thereof, said back opening located above and extending at least to said horizontal position, said horizontal position corresponding to an outermost position of said platform, whereby, during use, flexible materials being worked on can be moved along said substantially uninterrupted working surface and pushed through the back opening of said chamber.

2. The cabinet according to claim 1 including means associated with said back panel for directing and supporting said movement of the back panel between the generally vertical position (A) and the generally horizontal position (B) comprising abutting portions on the back panel and on the chamber.

3. The cabinet according to claim 2 wherein said means associated with said back panel comprise cam means shaped and configured to direct and support said movement of said back panel between said positions, said cam means being positioned on a bottom of said chamber and on said back panel.

4. The cabinet according to claim 3, wherein said platform is supported for rectilinear motion inwardly and outwardly of said chamber, said back panel being flexibly connected to said platform by a hinge.

5. The cabinet according to claim 4 wherein said cam means includes first cam means fixed to a bottom portion of said chamber and second cam means fixed to said back panel, said first and second cam means co-operating together to effect pivotal motion of said back panel relative to said platform about said hinge as said platform is moved toward and away from said outermost position.

6. The cabinet according to claim 5 including third cam means on said chamber adjacent said back opening co-operating with said back panel to guide said back panel toward and away from said generally vertical position as said platform is moved toward and away from said innermost position.

7. The cabinet according to claim 6 wherein said third cam means comprise upright members located adjacent opposing ends of said chamber for engaging free upper edge portions of said back panel at opposing ends thereof to effect guiding of said back panel, and securing means defining a recess at each of the opposing ends of said chamber to receive said free upper edge portions and to secure said back panel in the generally vertical position.

8. The cabinet according to claim 3 wherein said cam means have abutting angled surfaces which co-operate such as to provide an initial resistance to inward motion of said platform thereby to preventing accidental or unwanted inward movement of the platform during normal use thereof.

9. The cabinet according to claim 1 including said frontal door for said chamber to fully close said chamber when said platform is in its innermost position with said back panel in the generally vertical position.

* * * * *

UNITED STATES PATENT AND TRADEMARK OFFICE

CERTIFICATE OF CORRECTION

PATENT NO. : 5,800,029

DATED : September 1, 1998

INVENTOR(S) : Joann Robertson, Andy Holisky

It is certified that error appears in the above-identified patent and that said Letters Patent is hereby corrected as shown below:

On the title page, item [30] Foreign Application Priority Data should read
-- Mar. 4, 1997 [CA] Canada .....2,199,101 --

Signed and Sealed this

Twenty-fifth Day of May, 1999

*Attest:*

Q. TODD DICKINSON

*Attesting Officer*

*Acting Commissioner of Patents and Trademarks*